US006484524B1

(12) United States Patent
Ulanov

(10) Patent No.: US 6,484,524 B1
(45) Date of Patent: Nov. 26, 2002

(54) SYSTEM OF AND A METHOD OF COOLING AN INTERIOR OF A ROOM PROVIDED WITH A WALL AIR CONDITIONING UNIT

(76) Inventor: Gennaty Ulanov, 5527 N. Utrecht Ave. Apt. 4A, Brooklyn, NY (US) 11219

( * ) Notice: Subject to any disclaimer, the term of this patent is extended or adjusted under 35 U.S.C. 154(b) by 0 days.

(21) Appl. No.: 09/902,816

(22) Filed: Jul. 12, 2001

(51) Int. Cl.[7] ..... F25D 23/12
(52) U.S. Cl. ..... 62/263; 62/419; 454/253
(58) Field of Search ..... 62/262, 263, 443, 62/419, 78; 454/184, 236, 253, 251

(56) References Cited

U.S. PATENT DOCUMENTS 2,150,263 A * 3/1939 Chesney ..... 250/46
2,210,458 A * 8/1940 Keilholtz ..... 98/1
4,007,024 A * 2/1977 Sallee et al. ..... 55/126
5,611,486 A * 3/1997 Paul ..... 239/56

* cited by examiner

*Primary Examiner*—Denise L. Esquivel
*Assistant Examiner*—Melvin Jones
(74) *Attorney, Agent, or Firm*—I. Zborovsky

(57) ABSTRACT

A system of and a method of cooling an interior of a room provided with a wall air conditioning unit has an air conditioning unit installable in a the wall of the room and having an inlet for entering of an outside air and an outlet which is open into the interior of the room, and a guide having one end connected with the output of the air conditioning unit and extending vertically upwardly from the air conditioning unit to an upper area of the room so as to release a cool air not at a level of the air conditioning unit but as the upper level of the room.

12 Claims, 1 Drawing Sheet

SYSTEM OF AND A METHOD OF COOLING AN INTERIOR OF A ROOM PROVIDED WITH A WALL AIR CONDITIONING UNIT

BACKGROUND OF THE INVENTION

The present invention relates to a wall air conditioning system for a room.

Wall air conditioning systems for rooms are known and widely utilized. Such a system has an air conditioning unit which is mounted in a wall of the room, usually under a window and the like. Air is aspirated into the air conditioning unit, cooled and moved and supplied by a fan into the room. Since the cold air is supplied into the room from air conditioning unit, it does not move upwardly, but instead only the lower area of the room is cooled, while the area above the air conditioning unit is not cooled.

SUMMARY OF THE INVENTION

Accordingly, it is an object of the present invention to provide a wall air conditioning unit for a room, which avoids the disadvantages of the prior art.

In keeping with these objects and with others which will become apparent hereinafter, one feature of present invention resides, briefly stated in a wall air conditioning system for a room which has an air conditioning unit installable in a the wall of the room and having an inlet for entering of an outside air and an outlet which is open into the interior of the room; and a guide having one end connected with said output of said air conditioning unit and extending vertically upwardly from said air conditioning unit to an upper area of the room so as to release a cool air not at a level of said air conditioning unit but as the upper level of the room.

When the wall air conditioning unit for a room is designed in accordance with the present invention, the cold air produced by the air conditioning unit is supplied to the upper area of the room and therefore more efficiently cools the room.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
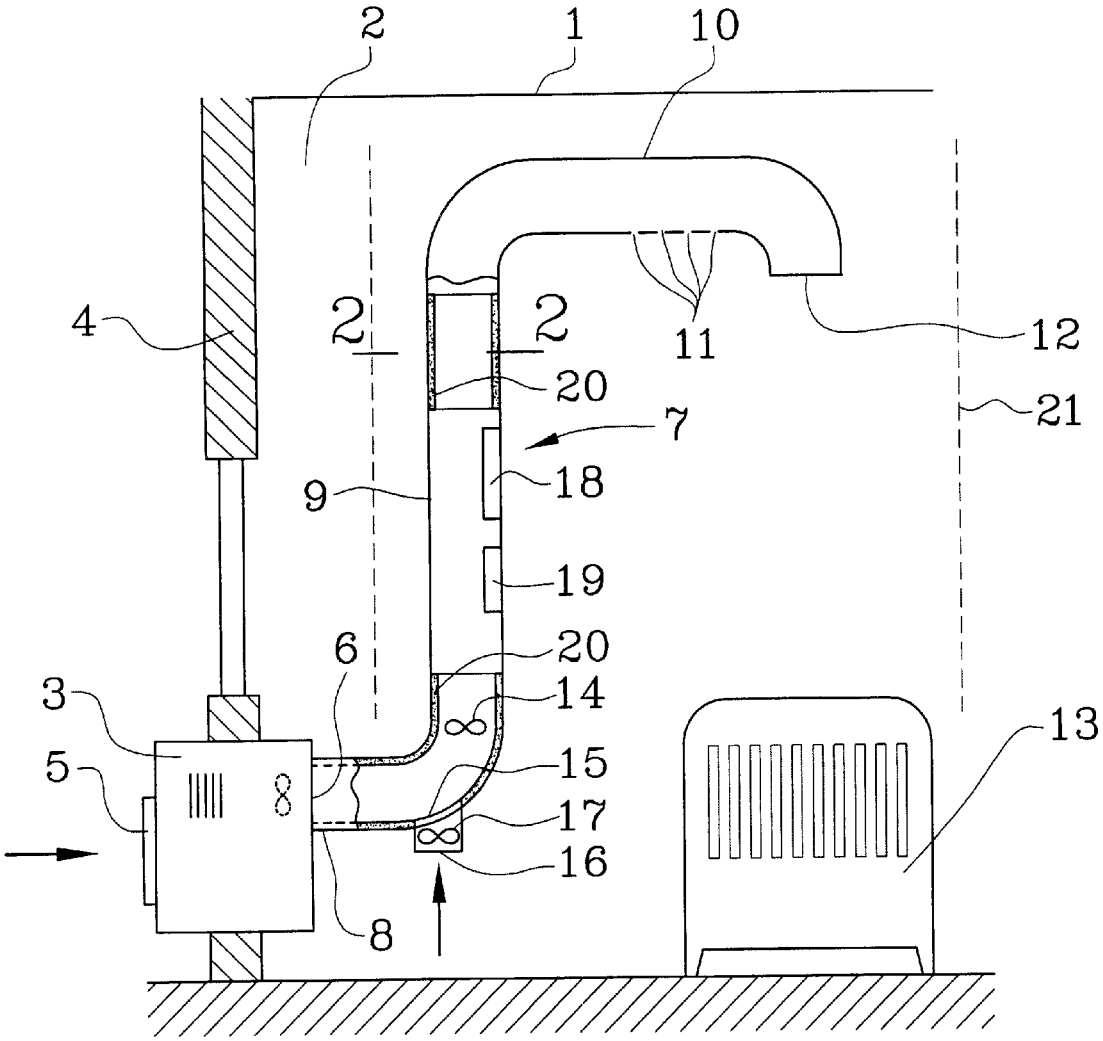
FIG. 1 is a view schematically showing a wall air conditioning system on a vertical elevational view.

A wall air conditioning unit is provided for cooling an interior of a room which is identified as a whole with reference numeral 1 while its interior is identified with reference numeral 2. The wall air conditioning system has an air conditioning unit which is identified with reference numeral 3. The wall air conditioning unit 3 is mounted in a wall 4 for of the room 1 so that its inlet 5 is located outside of the room, while its outlet 6 is located inside the room. The air conditioning unit is provided with known means for aspirating the exterior air, cooling the air, and pumping the cooled air into the room 1. It is believed that the wall air conditioning unit 3 can be located not necessarily in the wall, but also installed in a window of the wall, etc. It is also believed to be clear that the room 1 can be a living room and also an industrial room and other enclosed space.

The wall air conditioning system in accordance with the present invention has an air guide which is identified as a whole with reference numeral 7. One end 8 of the air guide 7 is connected with the outlet 6 of the air conditioning unit. The air guide has a portion 9 which extends substantially vertically upwardly and a portion 10 which extends substantially horizontally at a high level of the room, in particular substantially higher than the level at which the air conditioning unit 3 is installed. The upper portion 10 of the air guide is provided with a plurality of outlet openings 11.

During the operation of the wall air conditioning system in accordance with the present invention, the exterior air is aspirated into the air conditioning unit 3, is cooled in the latter and supplied into the air guide 7, so that the cooled air first flows upwardly through the portion 9 and then horizontally through the portion 10 and exits through the outlets 11 at a significant height of the room 1. Since hot air usually travels upwardly, the cold air issued through the openings 11 is mixed with the hot air and cools the interior air of the room 1.

In accordance with another feature of the present invention, the air guide 7 has a main outlet 12 which is preferably located above an area in which a bed 14 is positioned in the room 1. Therefore, the cooled air is supplied toward the bed and therefore directly toward a portion who uses the bed. In accordance with still a further feature of the present invention, an additional fan 14 is located inside the air guide 7 close to its first end 8, so that air is forcedly moved by the fan 14 through the air guide 7.

In accordance with still a further feature of the present invention, the air guide 7 is provided with an additional inlet 15 located in its lower part, a filter 16 arranged before the inlet 15, and an additional fan 17. Therefore air from the interior 2 of the room 1 is supplied through the filter 13, is cleaned by the filter 16, then is supplied through the opening 15 by the fan 17 into the air guide to be supplied through the air guide 7 and to issue through the openings 11 and 12.

In accordance with still a further feature of the present invention, ionizing means are provided in the air guide 7 so as to ionize the air supplied through the air guide and then to issue the ionized cold air through the openings 11 and 12. In addition, also smell generating means 19 can be located in the air guide so as add smell to the cooled air, and therefore the cooled air with corresponding smell issues through the openings 11 and 12.

Figure 2:
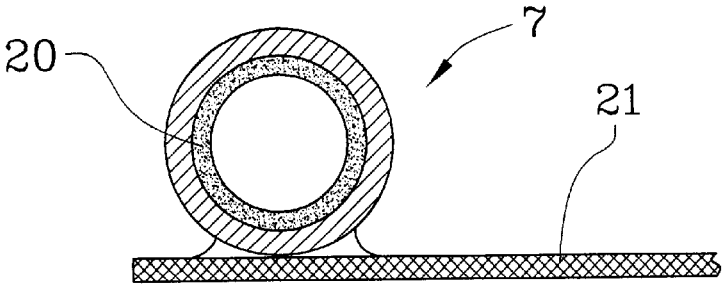
FIG. 2 is a view showing a transverse cross-section of an air guide of the inventive wall air conditioning system.

The air guide can be formed as a hose which is provided with an inner sound insulating layer 20. The sound insulating layer 20 can be composed of a non-sound insulating material, for example a woven sound insulating material and the like. Since the air guide 7 extends vertically upwardly along horizontally in the interior tool of the room 1, it is possible that it will not satisfy the static taste of a user. For this purpose the hose 7 is attached to an element 21 which is formed as a known curtain. It is shown in solid lines in FIG. 2 and in broken lines in FIG. 1. The hose 7 is located behind the curtain 21 and connected with it by known means, for example by sewing. The curtain, in addition to hiding of the air guide 7 also provides its support on a wall of the room 1 since it is suspended on known curtain suspending means.

In contrast to the known wall air conditioning systems for rooms in which the cold air is supplied near the floor in the lower level, or in other words at the level of the air conditioning unit, the air conditioning system in accordance with the present invention supplies the cold air from the top of the room.

It will be understood that each of the elements described above, or two or more together, may also find a useful application in other types of constructions differing from the types described above.

While the invention has been illustrated and described as embodied in a system of and a method of cooling an interior of a room provided with a wall air conditioning unit, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A system of and a method of cooling an interior of a room provided with a wall air conditioning unit, comprising an air conditioning unit installable in a wall of the room and having an inlet for entering of an outside air and an outlet which is open into the interior of the room; and a guide having one end connected with said output of said air conditioning unit and extending vertically upwardly from said air conditioning unit to an upper area of the room so as to release a cool air not at a level of said air conditioning unit but at the upper level of the room; said air guide being provided with a sound insulating interior means.

2. A system as defined in claim 1, wherein said guide includes an upper portion provided with a plurality of outlet openings.

3. A system as defined in claim 1, wherein said air guide is provided with an upper portion having a main outlet for exiting the cooled air.

4. A system as defined in claim 1; and further comprising a fan located upstream of said one end of said air guide so as to forcedly move the cooled air vertically upwardly.

5. A system as defined in claim 1, wherein said air guide has an additional inlet for entering an air in the interior of the room, and an additional fan which moves the air aspirated from the interior of the room vertically upwardly.

6. A system as defined in claim 5; and further comprising a filter arranged so that the air from the interior of the room is first filtered before a moving into said air guide.

7. A system as defined in claim 1; and further comprising means provided inside said air guide for ionizing the cooled air.

8. A system as defined in claim 1; and further comprising means for generating smell and locating inside said air guide so as to add smell to the cooled air.

9. A system as defined in claim 1, wherein said air guide has an upper portion and an outlet facing downwardly toward an area in the room in which a bed is to be located so as to supply the cooled air toward the bed.

10. A system of and a method of cooling an interior of a room provided with a wall air conditioning unit, comprising an air conditioning unit installable in a wall of the room and having an inlet for entering of an outside air and an outlet which is open into the interior of the room; a guide having one end connected with said output of said air conditioning unit and extending vertically upwardly from said air conditioning unit to an upper area of the room so as to release a cool air not at a level of said air conditioning unit but at the upper level of the room; and a curtain, said air guide being connected with said curtain.

11. A system of and a method of cooling an interior of a room provided with a wall air conditioning unit, comprising an air conditioning unit installable in a wall of the room and having an inlet for entering of an outside air and an outlet which is open into the interior of the room; and a guide having one end connected with said output of said air conditioning unit; said air guide being provided with a sound insulating interior means.

12. A system of and a method of cooling an interior of a room provided with a wall air conditioning unit, comprising an air conditioning unit installable in a wall of the room and having an inlet for entering of an outside air and an outlet which is open into the interior of the room: a guide having one end connected with said output of said air conditioning unit; and a curtain, said air guide being connected with said curtain.

* * * * *